United States Patent [19]
Inoue et al.
[11] Patent Number: 4,907,550
[45] Date of Patent: Mar. 13, 1990

[54] APPARATUS FOR CHANGING OPERATION TIMING OF VALVES FOR INTERNAL COMBUSTION ENGINE

[75] Inventors: Kazuo Inoue, Tokyo; Masaaki Katoh, Saitama, both of Japan

[73] Assignee: Honda Giken Kogyo Kabushiki Kaisha, Tokyo, Japan

[21] Appl. No.: 107,977

[22] Filed: Oct. 14, 1987

[30] Foreign Application Priority Data

Oct. 23, 1986 [JP] Japan ..... 61-252625

[51] Int. Cl.[4] ..... F01L 1/34
[52] U.S. Cl. ..... 123/90.16
[58] Field of Search ..... 123/90.16, 90.17, 90.44, 123/198 F

[56] References Cited

U.S. PATENT DOCUMENTS

| | | | |
|---|---|---|---|
| 2,829,540 | 4/1958 | Niemeyer | 74/569 |
| 3,299,869 | 1/1967 | Sicklesteel | 123/90.27 |
| 3,722,484 | 3/1973 | Gordini | 123/90.27 |
| 4,151,817 | 5/1979 | Mueller | 123/90.16 |
| 4,167,931 | 9/1979 | Iizuka | 123/198 F |
| 4,203,397 | 5/1980 | Soeters Jr. | 123/90.16 |
| 4,206,734 | 6/1980 | Perr et al. | 123/502 |
| 4,354,460 | 10/1982 | Mae et al. | 123/90.16 |
| 4,448,156 | 5/1984 | Henault | 123/90.17 |
| 4,499,870 | 2/1985 | Aoyama | 123/198 F |
| 4,523,550 | 6/1985 | Matsuura | 123/90.16 |
| 4,534,323 | 8/1985 | Kato et al. | 123/90.16 |
| 4,535,732 | 8/1985 | Nakano et al. | 123/90.16 |
| 4,537,164 | 8/1985 | Ajiki et al. | 123/90.16 |
| 4,537,165 | 8/1985 | Honda et al. | 123/90.16 |
| 4,545,342 | 10/1985 | Nakano et al. | 123/90.16 |
| 4,567,861 | 2/1986 | Hara et al. | 123/90.16 |
| 4,576,128 | 3/1986 | Kenichi | 123/198 F |
| 4,584,974 | 4/1986 | Aoyama et al. | 123/90.16 |
| 4,589,387 | 5/1986 | Miura et al. | 123/198 F |
| 4,612,884 | 9/1986 | Ajiki et al. | 123/90.16 |
| 4,615,307 | 10/1986 | Kodama et al. | 123/90.16 |
| 4,656,977 | 4/1987 | Nagahiro et al. | 123/90.16 |
| 4,690,110 | 9/1987 | Nishimura et al. | 123/90.17 |
| 4,727,831 | 3/1988 | Nagahiro et al. | 123/90.16 |

FOREIGN PATENT DOCUMENTS

| | | | |
|---|---|---|---|
| 2141172 | 12/1984 | European Pat. Off. . | |
| 0186341 | 7/1986 | European Pat. Off. . | |
| 0213758 | 3/1987 | European Pat. Off. . | |
| 2185784 | 7/1987 | European Pat. Off. . | |
| 3613945 | 10/1986 | Fed. Rep. of Germany . | |
| 1003568 | 3/1952 | France . | |
| 59-25012 | 2/1984 | Japan | 123/90.16 |
| 60-30405 | 2/1985 | Japan | 123/90.16 |
| 61-19911 | 1/1986 | Japan . | |
| 61-81510 | 4/1986 | Japan . | |
| 511903 | 8/1939 | United Kingdom . | |
| 1399813 | 7/1975 | United Kingdom . | |
| 2054036 | 2/1981 | United Kingdom . | |
| 2066361 | 7/1981 | United Kingdom . | |
| 2159877 | 12/1985 | United Kingdom . | |

*Primary Examiner*—Andrew M. Dolinar
*Attorney, Agent, or Firm*—Lyon & Lyon

[57] ABSTRACT

Valve operating apparatus is disclosed in which intake or exhaust valves for an internal combustion engine are operated by rocker arms driven by cams and have a hydraulically operated coupling mechanism for selectively connecting or disconnecting adjacent rocker arms to vary the operation timing of the valves under different engine operating conditions. The fluid circuit for operating the coupling mechanism contains a valve which is energized to a closed position during low-speed engine operation and de-energized to an open position during high-speed engine operation.

5 Claims, 5 Drawing Sheets

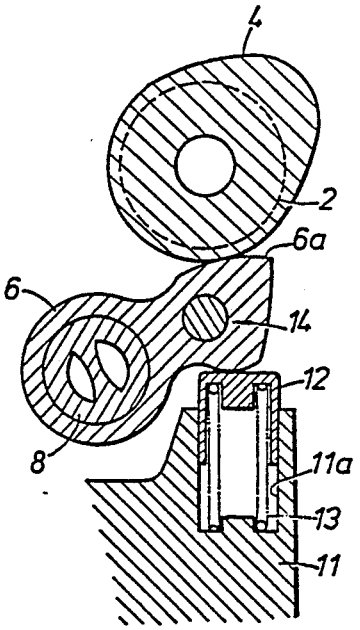
FIG. 2.
FIG. 3.
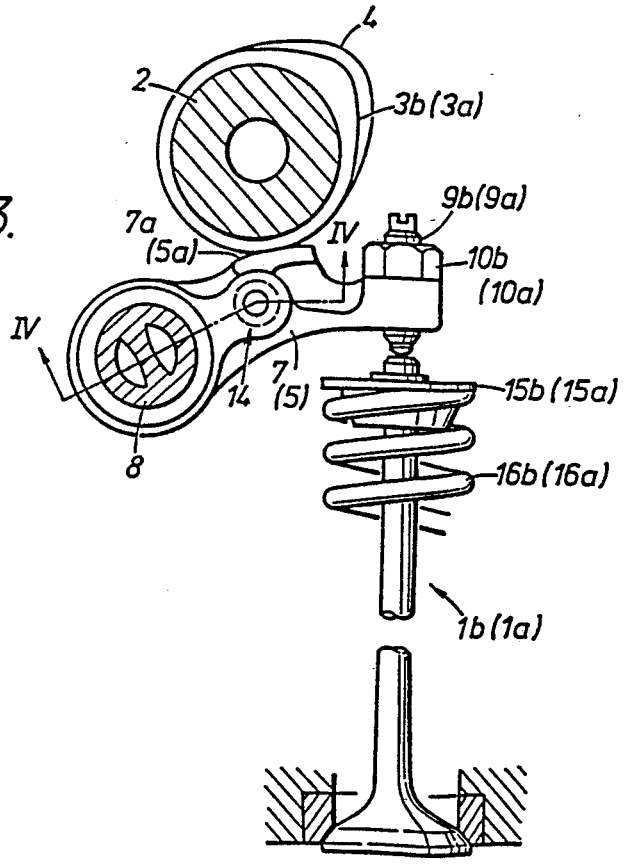

APPARATUS FOR CHANGING OPERATION TIMING OF VALVES FOR INTERNAL COMBUSTION ENGINE

BACKGROUND OF THE INVENTION

The present invention relates to a device for changing, in discrete steps, the operation timing of an intake valve or an exhaust valve according to the speed of rotation of an internal combustion engine.

Combustion chambers of four-cycle engines have intake and exhaust valves for supplying an air-fuel mixture and for discharging a combustion gas according to engine operation cycles. These valves are normally urged in a closing direction by valve springs disposed around the respective valve stems. The intake and exhaust valves can be forcibly opened against the resiliency of the valve springs by cams integrally formed on a camshaft that is driven by the crankshaft of the engine through a belt and pulley mechanism.

There have been proposed a variety of engine arrangements in which each engine cylinder is provided with a plurality of intake or exhaust valves. In such engine arrangements, when the engine operates at a low speed, one of the intake or exhaust valves is actuated, and when the engine operates at a high speed, all of the intake or exhaust valves are actuated. At the same time, the operation timing of the valves is varied according to the rotational speed of the engine for thereby increasing the efficiency of charging the air-fuel mixture into the combustion chamber over a wide range of engine operating conditions. One such device for changing the valve operation timing in an internal combustion engine is disclosed in Japanese Laid-Open Patent Publication No. 61-19911 filed by the applicant of the present application.

The device for changing the valve operating timing disclosed in this publication is operated by a power source which may be the pressure of the lubricating oil supplied by an oil pump operatively coupled to the engine crankshaft. Therefore, the valve timing changing device is subject to electrical control by a solenoid-operated valve which controls the flow of the lubricating oil.

If the solenoid-operated valve or the electric control circuit for controlling the solenoid-operated valve fails, the valve timing changing device cannot be controlled in the high engine speed range, and the valves must be operated in the low speed mode even if the engine speed is high. When this occurs, the balancing between the ignition timing and the air-fuel ratio may deviate from optimum values, thereby resulting in inefficient engine operation.

In view of the aforesaid problems attendant with such prior art arrangements, it is an object of the present invention to provide a valve operation timing changing device for an internal combustion engine, which is capable of maintaining relatively stable engine operation conditions even when an electric control circuit, or a solenoid-operated valve, malfunctions.

SUMMARY OF THE INVENTION

According to the present invention, the above object can be achieved by providing a valve operation timing changing device in an internal combustion engine for selectively changing the operation timing of intake or exhaust valves disposed in intake or exhaust ports of a combustion chamber and normally urged by spring means in a closing direction, wherein the valves are openable by a cam rotatable in synchronism with a crankshaft and variable under the application of hydraulic pressure between a first condition suitable for low-speed operation of the engine and a second condition suitable for high-speed operation of the engine, said valve operation timing changing device comprising means for normally biasing the operation timing toward said first condition, and a hydraulic pressure generator for producing a discharge pressure which increases as the rotational speed of the engine increases, the arrangement being such that the operation timing is brought into said second condition when said discharge pressure is greater than a prescribed level.

Since the hydraulic pressure is lowered in the low-speed range of the engine, the operation timing is brought by urging means into the first condition suitable for the low-speed operation. In the high-speed range in which the hydraulic pressure is increased, the operation timing is brought into the second condition suitable for the high-speed operation.

For a better understanding of the invention, its operating advantages and the specific objectives obtained by its use, reference should be made to the accompanying drawings and description which relate to a preferred embodiment thereof.

BRIEF DESCRIPTION OF THE DRAWINGS

FIG. 2 is a cross-sectional view taken along line II—II of FIG. 1;

FIG. 3 is a view, partly in section, as viewed in the direction of the arrow III in FIG. 1;

DESCRIPTION OF A PREFERRED EMBODIMENT

Figure 1:
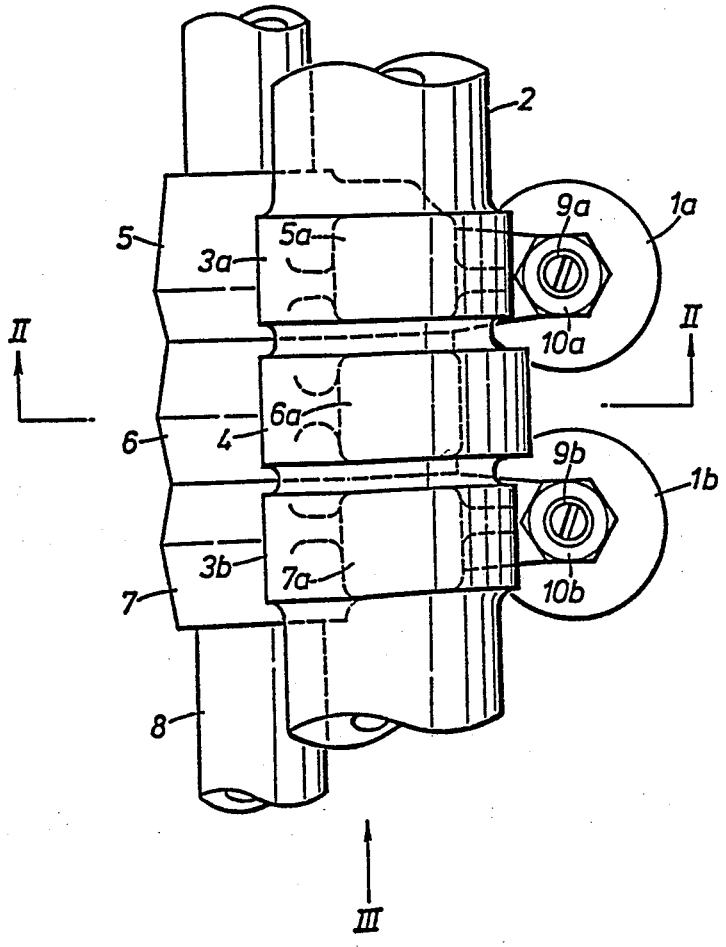
FIG. 1 is a plan view of a valve operating mechanism having a valve operation timing changing device according to the present invention.

With reference to FIG. 1, the body of an internal combustion engine (not shown) has a pair of intake valves 1*a*, 1*b* which can be opened and closed by a pair of low-speed cams 3*a*, 3*b* of egg-shaped cross section and a single high-speed cam 4. The cams 3*a*, 3*b*, 4 are integrally formed on a camshaft 2 rotatable in synchronism with rotation of the engine at a speed ratio of $\frac{1}{2}$ with respect to the speed of a camshaft (not shown), and operate first through third rocker arms 5, 6, 7 swingable as transmission members in engagement with these cams. The internal combustion engine also has a pair of exhaust valves (not shown) which can be opened and closed in the same manner as the intake valves 1*a*, 1*b*.

The first through third rocker arms 5, 6, 7 are disposed adjacent to each other and are swingably supported on a rocker shaft 8 disposed below and extending parallel to the camshaft 2. The first and third rocker arms 5, 7 are basically of the same configuration having proximal portions pivotally supported on the rocker shaft 8 and free ends extending over the intake valves 1*a*, 1*b*. The free ends of the rocker arms 5, 7 support tappet screws 9*a*, 9*b*, respectively, adjustably threaded therethrough and engaging the upper ends of the valve stems of the intake valves 1*a*, 1*b*. As shown, the tappet screws 9*a*, 9*b* can be locked by lock nuts 10*a*, 10*b* in order that they will not loosen.

The second rocker arm 6 is swingably supported on the rocker shaft 8 between the first and third rocker arms 5, 7. The second rocker arm 6 extends from the rocker shaft 8 slightly toward a position intermediate the intake valves 1*a*, 1*b*. As better illustrated in FIG. 2, the second rocker arm 6 has a cam slipper 6*a* on its upper surface slidably held against the high-speed cam 4. The lower surface of the distal end of the second rocker arm 6 is in abutment against the upper end of a lifter 12 slidably fitted in a guide hole 11*a* defined in a cylinder head 11. A coil spring 13 is disposed under compression between the inner surface of the lifter 12 and the bottom of the guide hole 11*a* for normally urging the lifter 12 in an upward direction, thereby to maintain the cam slipper 6*a* of the second rocker arm 6 in sliding contact with the high-speed cam 4 at all times.

As described above, the camshaft 2 is rotatably supported above the engine body, and has the low-speed cams 3*a*, 3*b* aligned with the first and third rocker arms 5, 7, respectively, and the high-speed cam 4 aligned with the second rocker arm 6. As better shown in FIG. 3, each of the low-speed cams 3*a*, 3*b* has a relatively small cam lift and a profile corresponding to low-speed operation of the engine. The outer peripheral surfaces of the low-speed cams 3*a*, 3*b* are slidably held in contact with cam slippers 5*a*, 7*a* on the upper surfaces of the first and third rocker arms 5, 7. The high-speed cam 4 has a relatively large cam lift of a larger angular extent than that of the low-speed cams 3*a*, 3*b* and a profile corresponding to high-speed operation of the engine. As described above, the outer peripheral surface of the high-speed cam 4 is slidably held against the cam slipper 6*a* of the second rocker arm 6. The lifter 12 is omitted from the illustration of FIG. 3.

The first through third rocker arms 5, 6, 7 are selectively brought into a first condition in which they are swingable together and another condition in which they are displaceable relative to each other by means of a coupling 14 (described hereinafter) mounted in holes that extend through the rocker arms 5, 6, 7 parallel to the rocker shaft 8.

Retainers 15*a*, 15*b* are mounted on the upper ends of the valve stems of the respective intake valves 1*a*, 1*b*. Valve springs 16*a*, 16*b* are disposed around the respective valve stems between the retainers 15*a*, 15*b* and the engine body for normally urging the intake valves 1*a*, 1*b* in a closing direction, i.e., upwardly as shown in FIG. 3.

Figure 4:
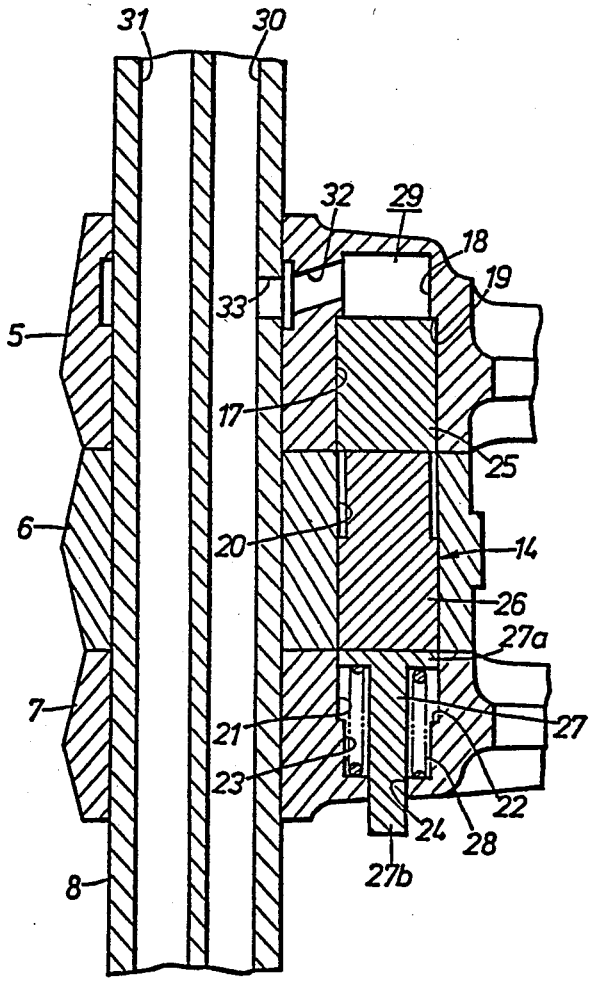
FIG. 4 is a cross-sectional view taken along line IV—IV of FIG. 3, showing the position of the parts during low-speed operation of the engine.
Figure 5:
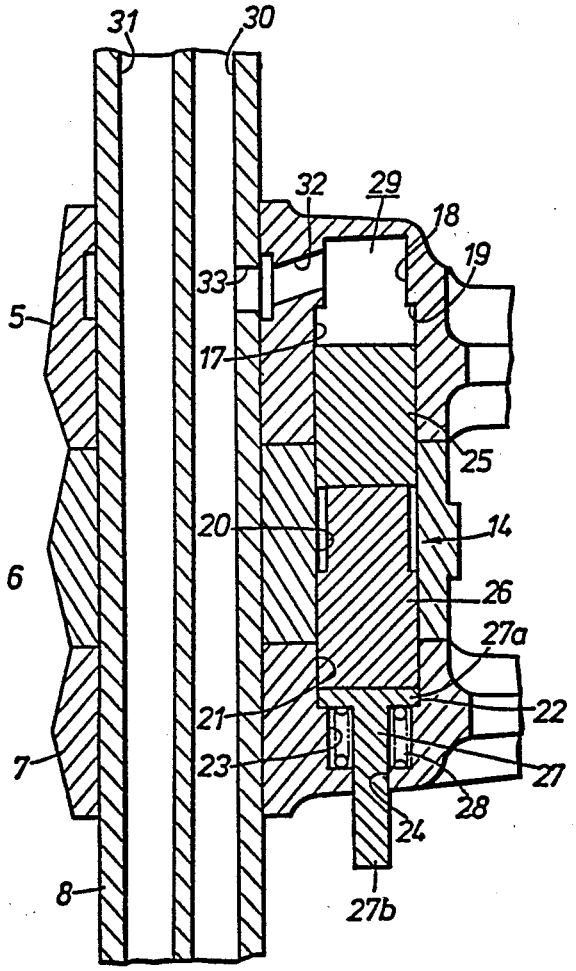
FIG. 5 is a view similar to FIG. 4, showing the position of the parts during high-speed operation of the engine.

As better shown in FIGS. 4 and 5, the first rocker arm 5 has a first guide hole 17 defined therein parallel to the rocker shaft 8 and opening toward the second rocker arm 6. The first rocker arm 5 also has a smaller-diameter hole 18 near the bottom wall of the first guide hole 17, with a step 19 being defined between the smaller-diameter hole 18 and the first guide hole 17. The second rocker arm 6 has a second guide hole 20 defined between its opposite side surfaces in communication with the first guide hole 17 of the first rocker arm 5. The third rocker arm 7 has a third guide hole 21 communicating with the second guide hole 20. The third rocker arm 7 also has a smaller-diameter hole 23 near the bottom wall of the third guide hole 21, with a step 22 being defined between the smaller-diameter hole 23 and the third guide hole 21. A smaller-diameter hole 24 is defined through the bottom wall of the third guide hole 21 concentrically therewith.

In the first through third guide holes 17, 20, 21, there are mounted a first piston 25 movable between a position in which it interconnects the first and second rocker arms 5, 6 and a position in which it releases them from each other; a second piston 26 movable between a position in which it interconnects the second and third rocker arms 6, 7 and a position in which it releases them from each other; a stopper 27 for limiting movement of the first and second pistons 25, 26; and a coil spring 28 for normally urging the first and second pistons 25, 26 in a direction toward their positions to release the first through third rocker arms 5, 6, 7 from each other.

The first piston 25 is slidably fitted in the first and second guide holes 17, 20, defining a hydraulic chamber 29 between the bottom of the hole 18 and the confronting end of the first piston 25. The rocker shaft 8 has a pair of supply passages 30, 31 communicating with a hydraulic pressure supply (described hereinafter). Working oil is supplied from the working oil supply passage 30 to the hydraulic chamber 29 through an oil passage 32 defined in the first rocker arm 5 in communication with the hydraulic chamber 29 and a hole 33 defined in the peripheral wall of the rocker shaft 8, irrespective of how the first rocker arm 5 is angularly moved. The pivotally supported portions of the rocker arms 5 through 7 are lubricated by lubricating oil supplied from the other lubricating oil supply passage 31 by apparatus not germain to this invention.

The first piston 25 has a length or axial dimension such that, when one end thereof abuts against the step 19 in the first guide hole 17, the other end of the piston 25 does not project from the side of the first rocker arm 5 which faces the second rocker arm 6. The second piston 26 has a length or axial dimension equal to the entire length of the second guide hole 30, and is slidably fitted in the second and third guide holes 20, 21.

The stopper 27 includes a disk 27*a* on one end thereof which is slidably fitted in the third guide hole 21 and a guide rod 27*b* on the other end which is inserted through the hole 24. A coil spring 28 is disposed around the guide rod 27*b* between the disk 27*a* and the bottom of the smaller-diameter hole 23. The coil spring 28 is compressed when the hydraulic pressure acting in the hydraulic chamber 29 reaches a prescribed level.

Figure 6:
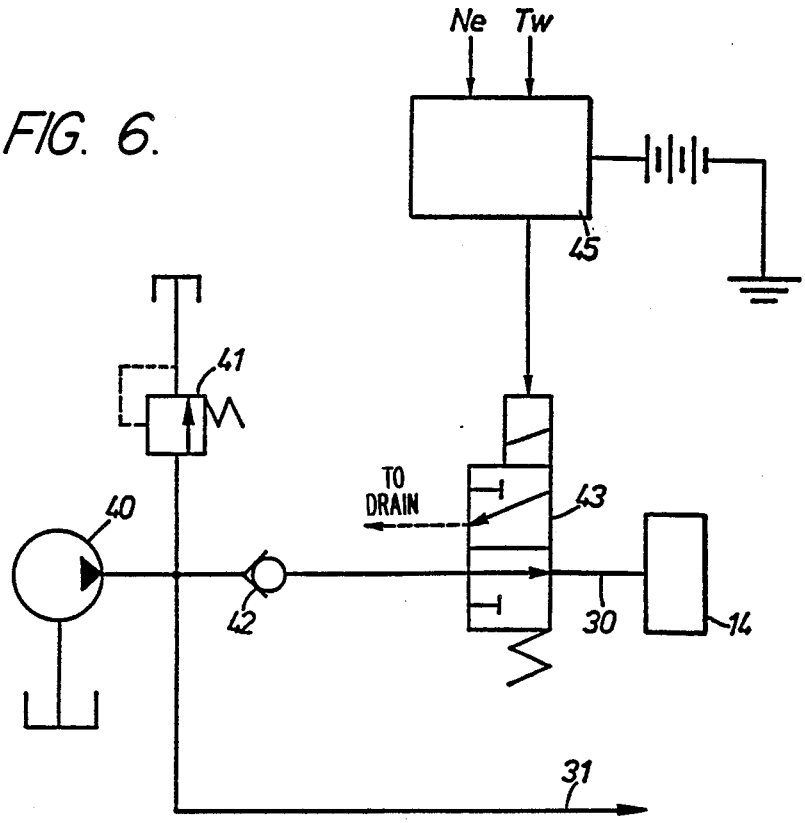
FIG. 6 is a schematic representation of a hydraulic circuit employed with the present invention.

FIG. 6 schematically illustrates a hydraulic pressure supply system connected to the device of the above embodiment. Lubricating oil is discharged by a lubricating oil pump 40 coupled to the crankshaft of the engine. This oil is applied to a relief valve 41 and is also divided into flows, the first of which is supplied to the working oil supply passage 30 in the rocker shaft 8 through a check valve 42 and a solenoid-operated valve 43 and the other of which is supplied to the lubricating oil supply passage 31. The pump 40 is designed such that its discharge pressure increases as the rotational speed of the engine increases.

The solenoid-operated valve 43 is controlled by a control signal from a control circuit 45. The control circuit 45 is supplied with a signal indicative of the engine rotational speed Ne and a signal indicative of the angle Tw of rotation of the crankshaft, and controls the solenoid-operated valve 43 according to conditions preset in the control circuit 45.

The operation of the hereindescribed organization is as follows. Referring to FIGS. 4 through 6, when the engine operates in a low- or medium-speed range, the solenoid-operated valve 43 is energized so that no hydraulic pressure is supplied to the working oil supply passage 30. Therefore, the pistons 25, 26 are positioned respectively in the guide holes 17, 20 under the bias of the coil spring 28, as shown in FIG. 4, whereupon the rocker arms 5, 6, 7 are relatively angularly movable. With the coupling 14 being thus in the releasing position, upon rotation of the camshaft 2, the first and third rocker arms 5, 7 are swung by sliding contact with the respective low-speed cams 3*a*, 3*b*. The intake valves 1*a*, 1*b* are thus opened at a delayed timing and closed at an advanced timing, with their lift being small. At this time, the second rocker arm 6 is swung by sliding contact with the high-speed cam 4, but the swinging movement thereof does not affect the operation of the intake valves 1*a*, 1*b*.

Lubricating oil is supplied under pressure to the fluid passage 31 at all times, so that the sliding surfaces of the rocker shaft 8 and the rocker arms 5, 7 are lubricated by the lubricating oil supplied via oil holes (not shown).

During high-speed operation of the engine, the solenoid-operated valve 43 is de-energized to open the valve and thereby introduce working oil pressure from the pump 40 into the hydraulic chamber 29 through the working oil supply passage 30, the hole 33, and the oil passage 32. As shown in FIG. 5, the first piston 25 is moved into the second rocker arm 6 under the hydraulic pressure against the bias of the coil spring 28, and the second piston 26 is pushed by the first piston 25 into the third rocker arm 7. As a result, the first and second pistons 25, 26 are moved together until the disk 27*a* of the stopper 27 abuts against the step 22. The first and second rocker arms 5, 6 are, at this time, interconnected by the first piston 25, and the second and third rocker arms 6, 7 are interconnected by the second piston 26.

When the first through third rocker arms 5, 6, 7 are thus interconnected by the coupling 14, the second rocker arm 6 in sliding contact with the high-speed cam 4 being swung to the greatest angular extent, the first and third rocker arms 5, 7 are swung in unison with the second rocker arm 6. Therefore, the intake valves 1*a*, 1*b* are opened at an advanced timing and closed at a delayed timing and their lift is increased according to the cam profile of the high-speed cam 4.

If the control circuit 45 or the solenoid-operated valve 43 fails during the low-speed operation of the engine, the solenoid-operated valve 43 is de-energized allowing the working oil to flow into the passage 30. However, during this range of engine operation the pressure of the oil discharged from the pump 40 is not sufficient to overcome the biasing force of the coil spring 28, and the pistons 25, 26 remain positioned in the low-speed mode as shown in FIG. 4.

As the engine speed increases from the low-speed range, the discharged oil pressure from the pump 40 also increases. When the oil pressure reaches a prescribed level, it moves the pistons 25, 26 into the high-speed mode as shown in FIG. 5 against the bias of the coil spring 28. The engine is now operated with the high-speed valve timing.

In the event of a control circuit or valve failure during high-speed operation of the engine, the solenoid-operated valve 43 remains unchanged in position, and the engine can operate normally. As the engine speed decreases from the high-speed range, the discharged oil pressure from the pump 40 falls and the pistons 25, 26 move back to their low speed mode under the resiliency of the coil spring 28. The engine is then operated with the low-speed valve timing.

The balancing between the oil discharge pressure from the pump 40, which is developed in the neighborhood of an engine rotational speed that actuates the coupling 14, and the resilient force of the coil spring 28 which urges the coupling 14 into the low-speed mode, is determined to meet the switching timing established in the control circuit 45. Therefore, the coupling 14 can continuously operate safely even in the event of a failure of the solenoid-operated valve 43 or the control circuit 45.

While in the above embodiment the two valves are simultaneously changed in their operation timing by the three separate rocker arms, the present invention is also equally applicable to a valve operation timing changing device for disabling one of the valves in a certain engine speed range by using two separate rocker arms.

It will be appreciated that in accordance with the described invention the coupling can operate safely even if the electric system fails, and such operation can be achieved without complicating the structure. Therefore, the reliability of the valve operation timing changing device can be increased.

While the present invention has been described herein in relation to intake valves it should be understood that the present invention is equally applicable to exhaust valves. Moreover, it should be further understood that, although a preferred embodiment of the invention has been illustrated and described herein, changes and modifications can be made in the described arrangement without departing from the scope of the appended claims.

We claim:

1. In a valve operation arrangement of an internal combustion engine including intake or exhaust valves normally urged by springs to close intake or exhaust ports of a combustion chamber; cam means rotated in synchronism with the engine crankshaft for operating said valves to open said ports; and a hydraulically operated valve operation timing changing device for varying the operation of said valves between a first condition and a second condition, said device comprising:

spring means for normally biasing said valve operation timing device in a mode for operating said valves in said first condition;

a fluid circuit operative to conduct operating fluid to said valve operation timing device in opposition to the bias of said spring means, said hydraulic circuit including a hydraulic pressure generating means for producing a fluid pressure in said hydraulic circuit that varies directly with the rotational speed of said engine; and said spring means having a spring force sufficient to place said valve operation timing device in a mode for operating said valves in said first condition while said hydraulic pressure in said fluid circuit is in a range of fluid pressures below a predetermined level and in a mode for operating said valves in said second condition when the hydraulic pressure in said fluid circuit exceeds said predetermined level.

2. The valve operating timing changing device according to claim 1 in which said first condition corresponds to low speed engine operation and said second condition corresponds to high speed engine operation.

3. The valve operating timing changing device according to claim 2 in which said fluid circuit comprising:

a fluid pump operative to supply hydraulic fluid to said timing changing device at pressures directly proportional to engine speed;

a control valve interposed in said fluid circuit between said fluid pump and said timing changing device; and control means for energizing said control valve to a closed condition during low speed engine operation and for de-energizing said control valve to an open condition during high speed engine operation.

4. The valve operation timing changing device according to claim 3 in which said control means senses engine rotational speed and engine crankshaft angle and activates said valve in response to a predetermined level of said sensed conditions.

5. The valve operation timing changing device according to claim 3 including a plurality of adjacent rocker arms pivotally mounted on a rocker shaft for operating said intake or exhaust valves; mutually registrable guide holes in said rocker arms; piston means operated by said fluid pressure and movable in said guide holes between a position in which said rocker arms are connected for movement in unison and disconnected for independent relative movement; said spring means normally biasing said piston means toward said rock arm-disconnect position; and said fluid circuit being arranged to supply said hydraulic fluid for moving said piston means into said rocker arm connected position against the force of said spring means.

* * * * *